US012281427B2

(12) United States Patent
Lee et al.

(10) Patent No.: US 12,281,427 B2
(45) Date of Patent: Apr. 22, 2025

(54) WASHING APPARATUS AND CONTROLLING METHOD THEREOF

(71) Applicant: Samsung Electronics Co., Ltd., Suwon-si (KR)

(72) Inventors: Seongdae Lee, Suwon-si (KR); Jeongnam Kim, Suwon-si (KR); Kyoungseop Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 196 days.

(21) Appl. No.: 18/298,015

(22) Filed: Apr. 10, 2023

(65) Prior Publication Data

US 2023/0243081 A1 Aug. 3, 2023

Related U.S. Application Data

(63) Continuation of application No. PCT/KR2021/015687, filed on Nov. 2, 2021.

(30) Foreign Application Priority Data

Dec. 11, 2020 (KR) ..... 10-2020-0173705

(51) Int. Cl.
*D06F 33/46* (2020.01)
*D06F 33/47* (2020.01)
(Continued)

(52) U.S. Cl.
CPC ..... *D06F 33/46* (2020.02); *D06F 33/47* (2020.02); *D06F 39/02* (2013.01); *D06F 39/085* (2013.01)

(58) Field of Classification Search
CPC ..... D06F 33/46
See application file for complete search history.

(56) References Cited

U.S. PATENT DOCUMENTS

| | | | |
|---|---|---|---|
| 11,105,034 | B2 | 8/2021 | Jang et al. |
| 2009/0066284 | A1 | 3/2009 | Lee |
| 2020/0190726 | A1 | 6/2020 | Jang et al. |

FOREIGN PATENT DOCUMENTS

| | | | |
|---|---|---|---|
| JP | 2015-047448 | A | 3/2015 |
| KR | 10-0404190 | B1 | 11/2003 |

(Continued)

OTHER PUBLICATIONS

International Search Report dated Feb. 16, 2022, issued in International Patent Application No. PCT/KR2021/015687.

*Primary Examiner* — Jason Y Ko
(74) *Attorney, Agent, or Firm* — Jefferson IP Law, LLP

(57) ABSTRACT

A method for controlling a washing apparatus including a power supply device is provided. The method includes controlling driving of a motor in a normal washing mode, determining temperature of the power supply device, controlling driving of the motor in an overheating prevention mode for reducing power consumption by the motor, when the temperature of the power supply device is equal to or higher than a first temperature, and repeating the driving in the overheating prevention mode multiple times such that the temperature of the power supply device is below a second temperature lower than the first temperature, wherein the repeating of the driving in the overheating prevention mode multiple times comprises controlling driving of a heater for heating washing water such that power consumption by the heater increases, when a number of times of driving in the overheating prevention mode is greater than a predetermined value.

15 Claims, 7 Drawing Sheets

(51) Int. Cl.
*D06F 39/02* (2006.01)
*D06F 39/08* (2006.01)

(56) References Cited

FOREIGN PATENT DOCUMENTS

| | | | |
|---|---|---|---|
| KR | 10-0606685 | B1 | 8/2006 |
| KR | 10-0794598 | B1 | 1/2008 |
| KR | 10-2010-0082666 | A | 7/2010 |
| KR | 10-2011-0045759 | A | 5/2011 |
| KR | 10-1053612 | B1 | 8/2011 |
| KR | 10-1136451 | B1 | 4/2012 |
| KR | 10-2020-0073060 | A | 6/2020 |

WASHING APPARATUS AND CONTROLLING METHOD THEREOF

CROSS-REFERENCE TO RELATED APPLICATION(S)

This application is a continuation application, claiming priority under § 365 (c), of an International application No. PCT/KR2021/015687, filed on Nov. 2, 2021, which is based on and claims the benefit of a Korean patent application number 10-2020-0173705, filed on Dec. 11, 2020, in the Korean Intellectual Property Office, the disclosure of which is incorporated by reference herein in its entirety.

BACKGROUND

1. Field

The disclosure relates to a washing apparatus and a controlling method thereof. More particularly, the disclosure relates to a washing apparatus that includes a power supply device and a controlling method thereof.

2. Description Related Art

A washing apparatus may be a machine that automatically washes laundry, such as clothing by using electricity, and may be formed such that a washing cycle, a rinsing cycle, a draining cycle, and a spin-drying cycle is to be performed according to an operation input by a user.

In the related art, a washing apparatus may be a device that includes a tub in which water of a certain amount is contained and a drum which is installed to be rotatable inside the tub, and is configured to perform each washing cycle as the drum containing laundry is rotated by an operation of a motor inside of the tub. In this case, a power supply device, which controls a rotation speed and torque of the motor and supplies power to the motor, is included.

However, there has been a problem, such as overheating occurring as a load to a power supply device is increased as an operation rate of the motor is increased by a use environment and a subject of washing of the washing apparatus. In addition, to address this issue, the operation rate of the motor may be changed by controlling an operation of the motor when a temperature of the power supply device is overheated, but in this case, there has been a problem of washing performance being deteriorated.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a washing apparatus with improved washing performance and prevents overheating of a power supply device, and a controlling method thereof.

Another aspect of the disclosure is to provide a washing apparatus with improved washing performance that does not increase washing time or include additional installations for an improvement in washing performance, and a controlling method thereof.

Additional aspects will be set forth in part in the description which follows and, in part, will be apparent from the description, or may be learned by practice of the presented embodiments.

In accordance with an aspect of the disclosure, a controlling method of a washing apparatus that includes a power supply device is provided. The controlling method includes controlling an operation of a motor in a general washing mode, determining a temperature of the power supply device, controlling, based on the temperature of the power supply device being greater than or equal to a pre-set first temperature, an operation of the motor in an overheating prevention mode that reduces power consumption of the motor, and repeating an operation in the overheating prevention mode a plurality of times such that the temperature of the power supply device becomes less than a second temperature which is lower than the first temperature, and the repeating an operation in the overheating prevention mode a plurality of times comprises controlling, based on a number of overheating prevention mode operations becoming greater than a pre-set value, an operation of a heater for power consumption of the heater that heats washing water to increase.

The controlling an operation of the heater may be additionally operating the heater for a pre-set time.

The controlling an operation of the heater may be additionally operating the heater for the temperature of the washing water to rise by a pre-set temperature difference.

The repeating an operation in the overheating prevention mode a plurality of times may include increasing, based on a number of overheating prevention mode operations becoming greater than the pre-set value, a driving force of a pump that is configured to supply the washing water to a drum.

The repeating an operation in the overheating prevention mode a plurality of times may include sensing a temperature of the washing water, and controlling, based on the temperature of the washing water being greater than or equal to a pre-set third temperature, the heater to reduce the temperature of the washing water, and increasing a driving force of a pump that is configured to supply the washing water to a drum.

The repeating an operation in the overheating prevention mode a plurality of times may include controlling, based on the number of overheating prevention mode operations becoming greater than the pre-set value, a detergent supply valve for a detergent supply amount of a detergent containing part that is configured to supply detergent to a drum to increase.

The repeating an operation in the overheating prevention mode a plurality of times may include controlling, based on the number of overheating prevention mode operations becoming greater than the pre-set value, a waterjet for a spray amount of the washing water of the waterjet configured to spray high-pressured washing water to a drum to increase.

The controlling method of the washing apparatus, may include controlling, based on the temperature of the power supply device becoming less than a pre-set second temperature, an operation of the motor in the general washing mode.

The controlling method of the washing apparatus, may further include determining whether a washing course is ended by an input signal, and the determining whether the washing course is ended may include returning back to determining the temperature of the power supply device based on the washing course not yet being ended.

After the determining whether a washing course is ended by an input signal, if the washing course is ended, determining a number of entries into the overheating prevention mode from among the washing course, and operating, based on the number of entries into the overheating prevention operation being greater than or equal to the pre-set value, the motor to supplement the washing performance may be included.

In accordance with another aspect of the disclosure, a washing apparatus is provided. The washing apparatus includes a main body provided with a tub, a rotatable drum provided in the tub and configured to contain laundry, a motor configured to provide motive power that rotates the drum, a heater configured to heat washing water in the tub, a power supply device configured to control a rotation of the motor, and a processor configured to control, based on a temperature of the power supply device being greater than or equal to a pre-set first temperature, an operation of the motor by repeating the operation in an overheating prevention mode that reduces power consumption of the motor a plurality of times such that the temperature of the power supply device becomes less than a second temperature which is lower than the first temperature, and the processor is configured to control, based on a number of overheating prevention mode operations being greater than a pre-set value, for the heater to operate so as to increase power consumption of the heater.

The processor may be configured to control an operation of the motor in a general washing mode based on a temperature of the power supply device becoming less than a pre-set second temperature from among the overheating prevention mode.

The power supply device may be configured to control an operation of the motor by including an Intelligent Power Module.

The washing apparatus may include a cooling fan configured to cool the power supply device, and the processor may be configured to increase a driving force of the cooling fan in the overheating prevention mode.

The washing apparatus may include a weight sensor configured to sense a weight of laundry contained in the drum and provide a sensing value to the processor, and the processor may be configured to increase the driving force of the cooling fan based on the sensing value of the weight sensor being greater than or equal to a pre-set weight.

The washing apparatus may include a pump configured to flow the washing water in the drum, and a water drain valve configured open and close such that the washing water in the drum is drained or maintained, and the processor may be configured to circulate, based on the number of overheating prevention mode operations being greater than the pre-set value, the washing water in the drum by controlling the pump and the water drain valve.

The washing apparatus may include a detergent containing part configured to supply detergent to the drum, and a detergent supply valve configured to open and close the detergent containing part, and the processor may be configured to control, based on the number of overheating prevention mode operations being greater than the pre-set value, the detergent supply valve to increase a detergent supply amount.

The washing apparatus may include a waterjet which includes a waterjet pump and a nozzle that sprays high-pressured washing water to the drum, and the processor may be configured to increase, based on the number of overheating prevention mode operations being greater than the pre-set value, a spray amount of the washing water in the waterjet.

The processor may be configured to increase an operation time of the motor based on the number of overheating prevention mode operations being greater than the pre-set value.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same reference numerals are used to represent the same elements throughout the drawings.

DETAILED DESCRIPTION

Figure 1:
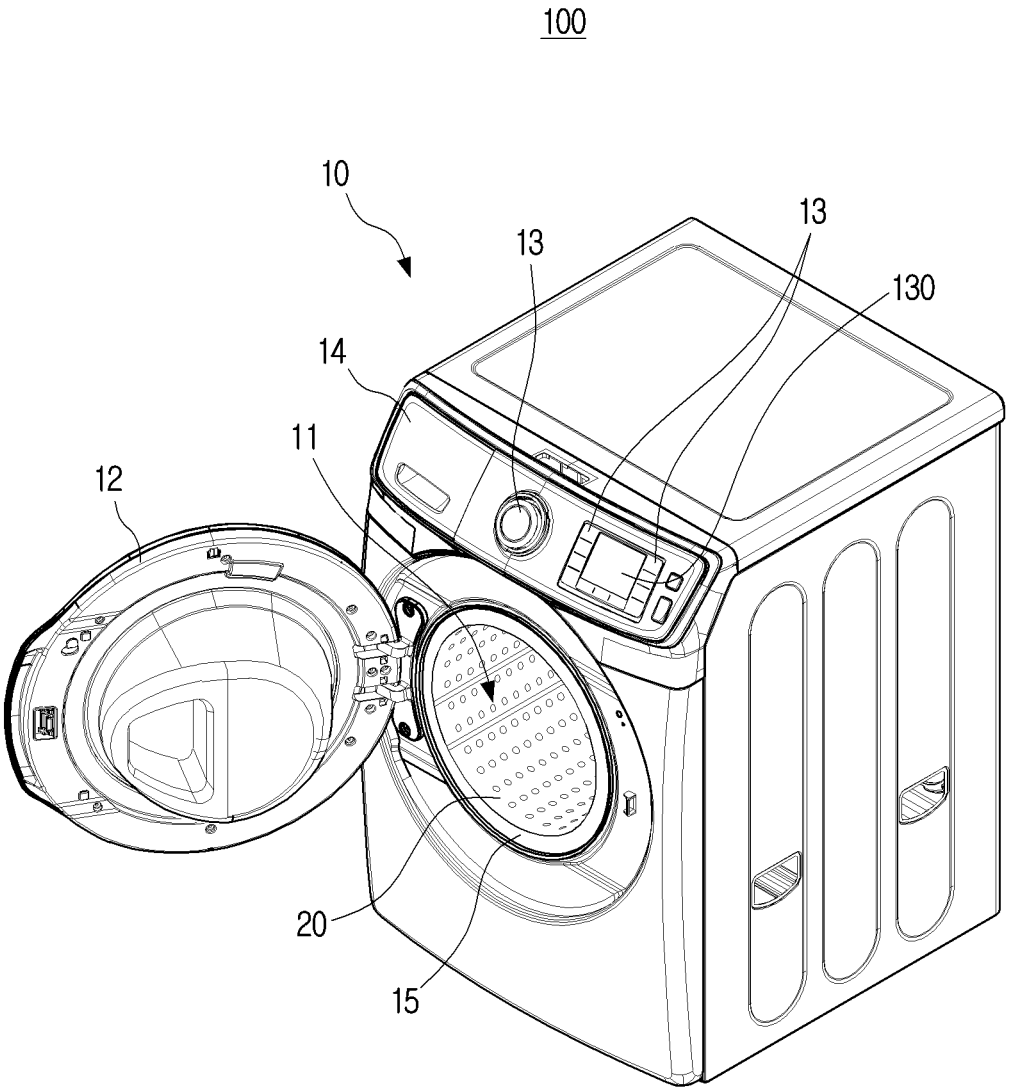
FIG. 1 is a perspective diagram illustrating a washing apparatus according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Various modifications may be made to the embodiments of the disclosure, and there may be various types of embodiments. Accordingly, specific embodiments will be illustrated in drawings, and the embodiments will be described in the detailed description. However, it should be noted that the various embodiments are not for limiting the scope of the disclosure to a specific embodiment of the disclosure, but they should be interpreted to include all modifications, equivalents or alternatives of the embodiments included in the ideas and the technical scopes disclosed herein. In case it is determined that in describing the embodiments of the disclosure, detailed description of related known technologies may unnecessarily confuse the gist of the disclosure, the detailed description will be omitted.

Terms, such as "first," and "second" may be used in describing the various elements, but the elements are not to be limited by the terms. The terms may be used only to distinguish one element from another.

A singular expression includes a plural expression, unless otherwise specified. It is to be understood that the terms, such as "consist" or "include" are used herein to designate a presence of a characteristic, number, step, operation, element, component, or a combination thereof, and not to preclude a presence or a possibility of adding one or more of other characteristics, numbers, steps, operations, elements, components or a combination thereof.

The term "module" or "part" used in the embodiments herein perform at least one function or operation, and may be implemented with a hardware or software, or implemented with a combination of hardware and software. Further, a plurality of "modules" or a plurality of "parts," except for a "module" or a "part" which needs to be implemented to a specific hardware, may be integrated to at least one module and implemented in at least one processor (not shown).

Embodiments of the disclosure will be described with reference to the accompanying drawings to aid in the understanding of those of ordinary skill in the art. However, the disclosure may be realized in various different forms and it should be noted that the disclosure is not limited to the various embodiments described herein. Further, in the drawings, parts not relevant to the description may be omitted, and like reference numerals may be used to indicate like elements.

A washing apparatus 100 and a controlling method thereof (S100) of the disclosure will be described below with reference to FIGS. 1 to 7.

FIG. 1 is a perspective diagram illustrating a washing apparatus according to an embodiment of the disclosure.

Referring to FIG. 1, the washing apparatus 100 may include a main body 10.

The washing apparatus 100 may refer to a device that performs washing of laundry using water and a detergent, and performs spin-drying of the wet laundry. In addition, according to an embodiment of the disclosure, the washing apparatus 100 may perform drying of the laundry which has completed spin-drying. For convenience of description below, the subject of washing by the washing apparatus will be referred to as 'laundry,' and water used in the washing will be referred to as 'washing water.'

The washing apparatus 100 may be mainly classified into a top-loading method in which an insertion hole 11 is provided at an upper part of the main body 10 and a rotation axis of the tub 15 is vertical to a ground surface, a front-loading method in which the insertion hole 11 is provided toward a front surface of the main body 10 and the rotation axis of the tub 15 is horizontal to the ground surface, or a hybrid method which combines the above methods. The top-loading method washing apparatus may be referred to as a 'typical washing apparatus' or a 'top loader washing apparatus,' and the front-loading method washing apparatus may be referred to as a 'drum washing apparatus.' FIG. 1 is shown based on the front-loading method drum washing apparatus, but the washing apparatus 100 and the controlling method thereof (S100) of the disclosure may be applied without being not limited thereto.

The main body 10 may form an exterior of the washing apparatus 100, and a laundry insertion hole 11 through which laundry may be placed into or taken out from an inside of the main body 10 may be provided at the front surface of the main body 10. At the laundry insertion hole 11, a door 12 may be installed to be openable and closeable. The washing apparatus 100 may contain laundry in the drum 20 of the tub disposed inside thereof through the insertion hole 11. An inside structure of the main body will be described with reference to FIG. 2.

At the front surface of the main body 10, an input device 13, such as a plurality of buttons and a rotation lever which can be operated by a user may be provided, and an input interface 170 for receiving input of a user command may be provided in the washing apparatus 100. In addition, at the front surface of the main body 10, a display 130 for displaying the washing apparatus 100 and information associated with washing may be included.

The detergent containing part 14 may supply a detergent, a fabric softener, and the like to the tub 15 of the washing apparatus 100. The detergent containing part 14 may transfer the detergent to the drum 20 during a water supplying process of the washing water. Specifically, when a water supply valve 113 is opened and water is supplied to the water supply pipe 30, water may be provided to the detergent containing part 14, and the detergent, the fabric softener, and the like contained in the detergent containing part 14 may be mixed with the water. Accordingly, the water mixed with the detergent, the fabric softener, and the like may be supplied to the tub 15.

Figure 2:
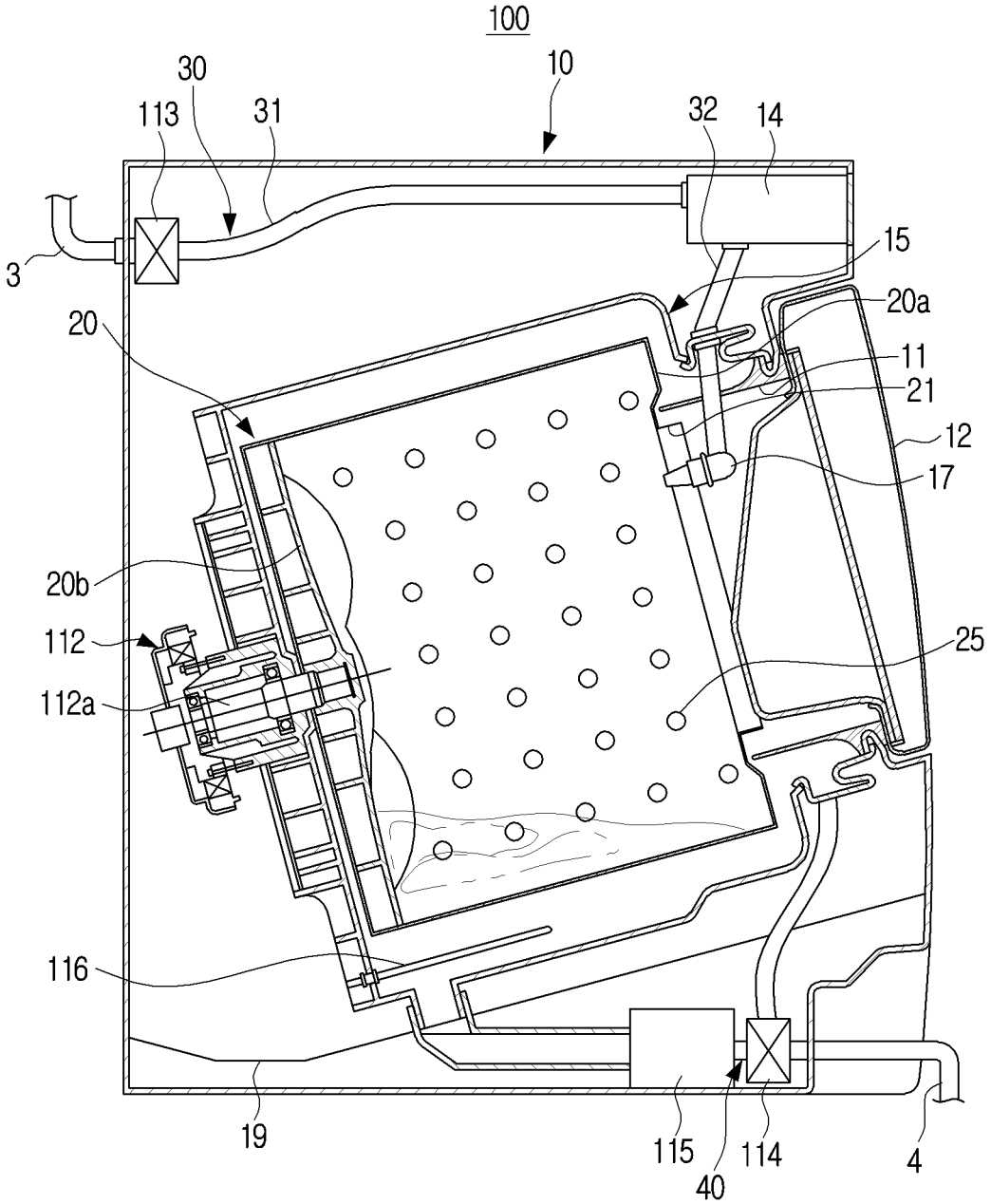
FIG. 2 is a cross-sectional diagram illustrating a washing apparatus according to an embodiment of the disclosure.

FIG. 2 is a cross-sectional diagram illustrating the washing apparatus according to an embodiment of the disclosure.

Referring to FIG. 2, the washing apparatus 100 may include a tub 15, a drum 20, a water supply pipe 30, and a water drain pipe 40.

The tub 15 may be provided inside the main body 10 of the washing apparatus 100, and formed in a cylindrical shape with an opening provided toward the laundry insertion hole 11. The tub 15 may store water of a predetermined amount necessary for washing. At a lower end of the main body, a water storage part 19 in which washing water leaked from the tub 15 is stored without being discharged to an outside.

The tub 15 may be installed at a predetermined angle with respect to an installation surface (e.g., a horizontal surface) of the washing apparatus 100 such that a front surface part of the tub 15 is positioned at a higher position than a back surface part of the tub 15 inside the main body 10.

Specifically, a front surface part 20*a* of the drum 20 may be installed to have a higher position then a back surface part 20*b*, that is, to have a pre-set angle (e.g., 5 degrees, 15 degrees, 30 degrees, or the like, based on the horizontal surface. However, this is merely one embodiment of the disclosure, and the front surface part 20*a* and the back surface part 20*b* of the drum 20 may be installed to have an angle (0 degree) that is not tilted.

At this time, the drum 20 may be installed inside the tub 15 at a same angle as a water tank. Here, the front surface part may refer to a surface at which an opening part formed in a same direction as the insertion hole 11 of the main body 10 is present for the laundry to be inserted, and the back surface part may refer to a surface that is opposite to the front surface part. Alternatively, the tub 15 may be disposed so as to be not tilted, and the rotation axis of the drum 20 may be provided in a direction that is horizontal with the ground surface.

The drum 20 may be installed inside the tub 15, realized in a cylindrical shape and may contain laundry that is inserted, and form a space in which laundry is washed. At the front surface of the drum 20, an opening corresponding with the laundry insertion hole 11 may be provided, and laundry may be inserted into the drum 20.

The drum 20 may be formed with a plurality of through holes 25, and the washing water inside the drum 20 may be drained to an external water drain pipe 400 by exiting through the plurality of through holes 25. Specifically, the washing water that is supplied from an external water supply pipe 300 at a water supplying cycle of the washing apparatus 100 may be supplied inside of the tub 15 through a nozzle connected with the water supply pipe 30. Then, the drum 20 may rotate at high speed by a motor 112 at a spin-drying cycle of the washing apparatus 100, the washing water inside the drum 20 may exit outside of the drum 20 through the plurality of through holes 25 of the drum 20 by a centrifugal force of the drum 20 rotating, and the washing water contained in a space in-between an outer wall of the drum 20 and an inner wall of the tub 15 may be drained to the external water drain pipe 400 along the water drain pipe 40.

The drum 20 may be rotatable based on a rotation axis 112*a*. A rotation revolution per minute (RPM) of the drum may vary according to a use of the washing apparatus and a performance of the motor, but may rotate, for example, between 1,000 and 3,000 times per minute. At the back surface part of the tub 15, the motor 112 and the rotation axis 112*a* of the driving part 110 may be installed to rotate the drum 20. The tub 15 may further include a suspension system (not shown) for damping vibrations generated at a time of a rotation operation of the drum 20. When the drum 20 is rotated by the motor 112, a filth of the laundry inserted inside the drum 20 may be removed from the laundry during a friction process with water stored in the tub 15.

At one side of the upper part of the tub 15, a spray nozzle 17 may be formed, and the spray nozzle 17 may be connected to the water supply pipe 30 to supply the washing water to the inside of the drum 20. At one side of the lower part of the tub 15, the water drain pipe 40 may be connected to drain the washing water. The washing water may refer to normal water, but the washing water may also refer to a mixture that further includes the detergent, contaminants, and the like in addition to the water.

At the back surface part 20*b* of the drum 20, the rotation axis 112*a* of the driving part 110 which is installed to the back surface part of the tub 15 may be coupled. In this case, the drum 20 may receive motive power (e.g., rotational force) generated from the motor 112 of the driving part 110 through the rotation axis 112*a* and may be rotated along an axial direction of the rotation axis 112*a*.

The washing apparatus 100 may include the water supply pipe 30 for supplying water to the tub 15 and the drum 20. The water supply pipe 30 may be connected with an external water supply source 3, such as a faucet and the like, and may include the water supply valve 113 configured to open and close the water supply pipe 30. The water supply pipe 30 may connect the external water supply pipe 300 with the tub 15 or the drum 20, and may be a flow path that is connected to supply washing water from the external water supply pipe 300 to the tub 15 or the drum 20. The water supply pipe 30 may be formed as a pair so as to supply cold water and hot water.

The detergent containing part 14 may supply the detergent to the drum 20, and the detergent may be transferred to the drum 20 by the water supply pipe 30. Specifically, the water supply pipe 30 may supply the detergent filled in the detergent containing part 14 together with the washing water, which is supplied from the external water supply pipe 300 and passes the detergent containing part 14, to the inside of the drum 20. The detergent containing part 14 may include a detergent supply valve 118 configured to open and close the detergent containing part, and control the detergent being supplied to the inside of the drum 20.

The water drain pipe 40 may connect the tub 15 with the external water drain pipe 400, and may be referred to as a flow path that is connected to drain the washing water filled in the drum 20 to the external water drain pipe 400. The water drain pipe 40 may be connected to a pump 115 that flows the washing water of the drum and a water drain valve 114 which is opened and closed for the washing water of the drum 20 to be drained or maintained. A processor 140 may control the pump 115 and the water drain valve 114 so as to control the washing water of the drum 20 to be drained to an outside, or to circulate back to the drum. When the water drain valve 114 is closed and the pump 115 is operated so as to control the washing water to circulate, fluidity of the washing water inside the drum 20 may increase, the washing water may be evenly be transferred to the laundry, and washing performance may be improved.

The driving part 110 may operate the overall operation of the washing apparatus 100. The driving part 110 may rotate the drum 20 or a pulsator (not shown) and operate a heater 116. The washing apparatus 100 may receive an input signal from the user and perform a plurality of unit cycles of the washing apparatus 100 through the driving part 110. The plurality of unit cycles may include a water supplying cycle, a washing cycle, a rinsing cycle, a spin-drying cycle, a water draining cycle, and the like. A detailed description on the driving part 110 and an operation of the washing apparatus 100 may be described with reference to FIG. 3.

Figure 3:
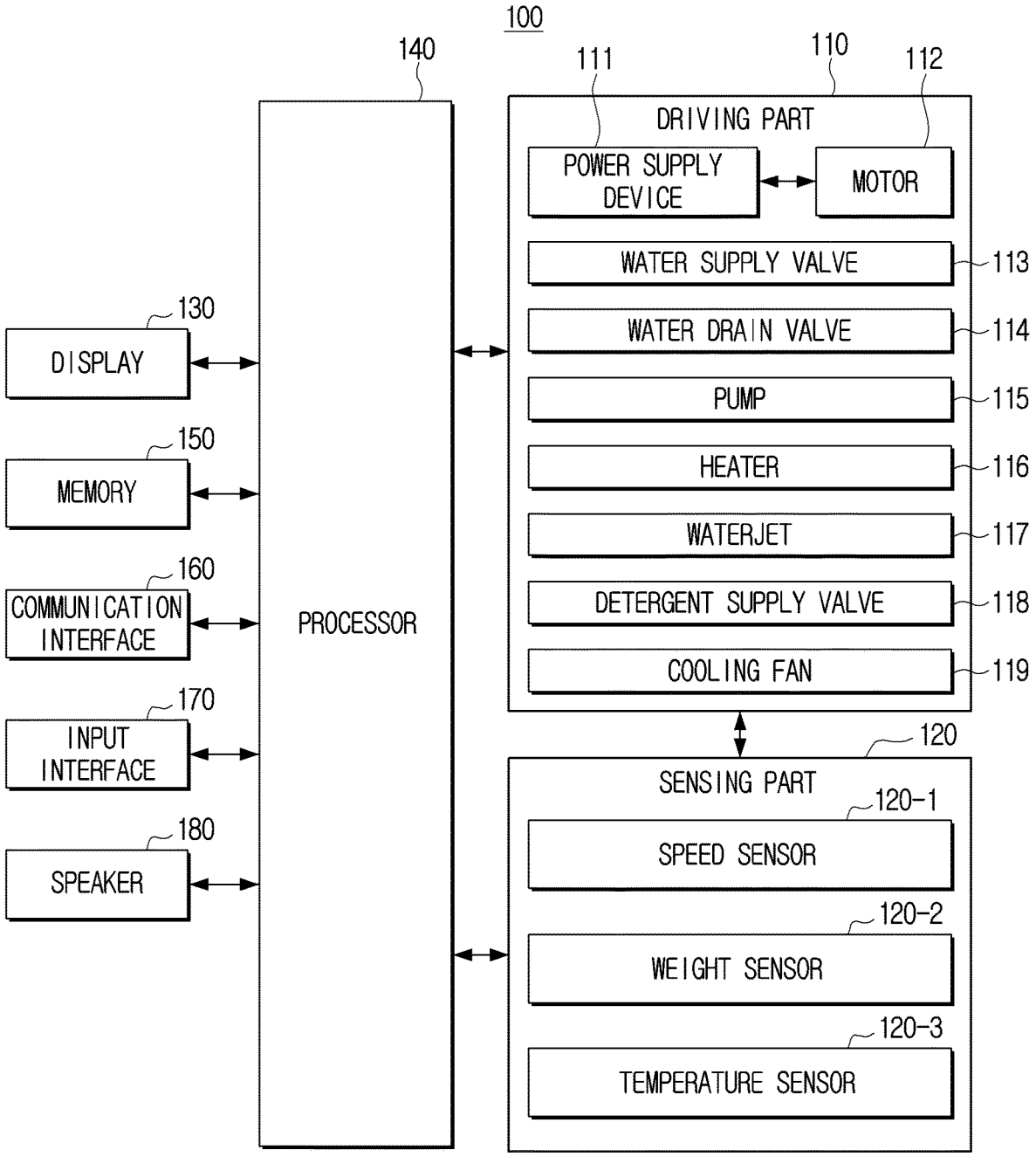
FIG. 3 is a block diagram illustrating a configuration of a washing apparatus according to an embodiment of the disclosure.

FIG. 3 is a block diagram illustrating a configuration of the washing apparatus according to an embodiment of the disclosure.

Referring to FIG. 3, the washing apparatus 100 may include a driving part 110, a sensing part 120, and the processor 140.

The driving part 110 may be a configuration for performing the overall mechanical operation of the washing apparatus 100, and may perform an operation according to a control of the processor 140. The driving part 110 may include a power supply device 111 and the motor 112, and may rotate the drum 20 of the washing apparatus 100.

The power supply device 111 may be a device that provides power to the motor 112, and controls the speed and torque of the motor 112. The power supply device 111 may control the speed of the motor 112 according to a control signal of the processor 140, and the power supply device 111 may control the speed of the motor 112 by using a voltage control method, a frequency conversion method, or the like.

The power supply device 111 may be controlled by an Intelligent Power Module (IPM) configured of a switching device. The Intelligent Power Module may be a power module added with a protective function to protect a power device, a driving circuit, and the like, and may prevent components of the power supply device 111 and the washing apparatus 100 from being damaged due to overheating by an increase in loading amount with respect to the power supply device 111 that controls the motor 112. An operation of the washing apparatus 100 associated therewith will be described with reference to FIG. 4.

The motor 112 may rotate the drum 20. Here, the motor 112 may be referred to as a prime mover that converts energy (e.g., power, or the like) applied from the outside to motive power energy. The motor 112 may include a stator, a rotor, a plurality of coils winded to the stator, and a plurality of magnets of the rotor, the rotor may rotate and generate an electromagnetic interaction between the coil and the plurality of magnets, and the motor 112 may generate motive power due to the electromagnetic interaction between the coil and the magnet. Specifically, the motor 112 may transfer the motive power energy to the rotation axis 112*a*, and the rotation axis 112*a* may be coupled with the motor 112 and the drum 20, and rotate the drum 20 by transferring the motive power transferred from the motor 112 to the drum 20. The rotation axis 112*a* may include a shaft axis, a bearing, and the like.

The motor 112 may transfer the motive power to the drum 20 through the rotation axis 112*a*. The rotation axis 112*a* may be combined to the back surface part 20*b* of the drum 20, and may rotate the drum 20 by transferring the motive power according to an operation of the motor 112 to the drum 20. If the washing apparatus 100 includes a pulsator, the drum 20 may include a pulsator (not shown) which is coupled to the rotation axis 112*a* and installed at a bottom surface inside thereof, and the motor 112 may rotate the pulsator by transferring the motive power to the pulsator through the rotation axis 112*a*.

The driving part 110 may include at least a portion from among the water supply valve 113, the water drain valve 114, the pump 115, the heater 116, a waterjet 117, and the detergent supply valve 118.

The water supply valve 113 may be opened and closed, by the control of the processor 140, such that the washing water is supplied to or blocked from the inside of the drum 20. The water supply valve 113 may be implemented as a solenoid valve, an electromagnetic valve, and the like which can be opened and closed by movement of the coil according to an applied current.

The water supply valve 113 may be installed between the external water supply pipe 300 and the water supply pipe 30 of the washing apparatus 100. The water supply pipe 30 of the washing apparatus 100 may connect the external water supply pipe 300 with the drum 20, and the washing water may be supplied to the inside of the drum 20 along the water supply pipe 30 when the water supply valve 113 is in an on-state. For example, the water supply valve 113 may control the washing water such that the washing water is supplied from the external water supply pipe 300 to the inside the drum 20 or blocked according to a state (an on-state or an off-state) of the water supply valve 113.

The water supply pipe 30 may include a first water supply pipe 31 that connects between the external water supply pipe 300 and the detergent containing part 14, and a second water supply pipe 32 that connects between the detergent containing part 14 and the drum 20. The washing water supplied from the external water supply pipe 300 may be supply the detergent filled in the detergent containing part 14 together with the washing water to the inside of the drum 20 by passing the detergent supply valve 118 and the detergent containing part 14.

The water drain valve 114 may be opened and closed, by the control of the processor 140, such that the washing water filled inside the drum 20 is drained or maintained. The water drain valve 114 may be implemented as a solenoid valve, an electromagnetic valve, and the like which can be opened and closed by movement of the coil according to the applied current.

The water drain valve 114 may be installed between the water drain pipe 40 of the washing apparatus 100 and the external water drain pipe 400. Here, the water drain pipe 40 of the washing apparatus 100 may connect the drum 20 with the external water drain pipe 400, and the washing water filled inside the drum 20 may be drained along the water drain pipe 40 to the external water drain pipe 400 when the water drain valve 114 is in the on-state. For example, the water drain valve 114 may control the washing water such that the washing water is drained or maintained from the inside of the drum 20 to the external water drain pipe 400 according to the state (the on-state or the off-state) of the water drain valve 114.

The pump 115 may discharge, by the control of the processor 140, the washing water filled inside the drum 20 to the external water drain pipe 400 by using motive power or pressure. To this end, the pump 115 may be installed between the water drain pipe 40 and the external water drain pipe 400.

The pump 115 may include a shaft (not shown) included with an impeller (not shown) and an electric motor (not shown) mechanically connected with the shaft, a suction pipe (not shown) connected with the water drain pipe 40, and a discharge pipe connected with the external water drain pipe 400, and the washing water in the drum 20 may pass the suction pipe and the discharge pipe and be forcibly discharged to the external water drain pipe 400 when the impeller is rotated by the electric motor of the pump 115 while the water drain valve 114 is in the on-state. In addition, the processor 140 may circulate the washing water of the drum 20 by operating the pump 115 while the water drain valve 114 is in the off-state.

The heater 116 may heat, when power is applied according to the control of the processor 140, the washing water of the drum 20 by converting the applied electric energy to heat energy. The heater 116 may be installed inside of the tub 15, and boil the laundry or clean the drum 20 by heating the washing water filled inside the drum 20. In addition, the heater 116 may heat the drum 20 and dry the laundry that is present inside the drum 20.

The waterjet 117 may include a waterjet pump (not shown), and a nozzle (not shown), and the washing water introduced by using the waterjet pump may be sprayed at high pressure through the nozzle and remove the contaminants that still remain inside the drum 20 by spraying at a specific position inside the drum 20. In this case, the waterjet 117 may be implemented as a separate device from the spray nozzle 17 for supplying the washing water inside the drum 20, or the waterjet 117 may also be implemented as one device integrated with the spray nozzle 17.

The detergent supply valve 118 may open and close the detergent containing part 14, and automatically control the detergent from being supplied to the inside of the drum 20. The washing apparatus 100 may be implemented to include a detergent supply device (not shown) by including the detergent supply valve 118, the detergent containing part 14, a detergent sensor (not shown), and the like. The detergent supply device (not shown) may contain and store detergent of a certain amount, calculate an amount of detergent necessary by the processor 140 at an operation of the washing apparatus 100 and open the detergent supply valve 118, and automatically provide the detergent of a certain amount to the drum 20. Accordingly, even if the user does not re-measure and insert the detergent at each operation of the washing apparatus 100, the detergent of an appropriate amount may be conveniently supplied by the supply device (not shown).

A cooling fan 119 may be controlled by the processor 140, and may cool the power supply device 111. The processor 140 may lower a temperature of the power supply device 111 by operating the cooling fan 119 when cooling of the power supply device 111 is necessary to prevent overheating of the power supply device 111 by the operation of the motor 112.

Specifically, the cooling fan 119 may be operated to cool the power supply device 111 or operated at a higher driving force by the processor 140 in an overheating prevention mode which will be described below. In this case, the power supply device 111 may reduce an operation time or a number of operations during the overheating prevention mode, and consequently assist in complementing washing performance by the overheating prevention mode of the washing apparatus 100.

Alternatively, according to an embodiment of the disclosure, the processor 140 may operate in association with a weight sensor 120-2 of the sensing part 120, and may be controlled in a method that increases the driving force of the cooling fan 119 when a sensing value of the weight sensor 120-2 is greater than or equal to a pre-set weight. In this case, because the power supply device 111 may be cooled in advance prior to entering the overheating prevention mode, the power supply device 111 may be prevented from converting to the overheating prevention mode or a frequency of entering the overheating prevention mode may be reduced. Accordingly, assistance may be provided in complementing the washing performance by the overheating prevention mode of the washing apparatus 100.

The sensing part 120 may sense an operating state, a surrounding environment, or the like of the washing apparatus 100, and generate and output an electrical signal of the sensed result. The sensing part 120 may transfer the electrical signal to the processor 140, or store the sensed result in a memory 150 of the washing apparatus 100 or in an external device. Specifically, the sensing part 120 may generate an electrical signal or obtain data by sensing the operating state, the surrounding environment, or the like of the washing apparatus 100 while the washing course is being performed, and the processor 140 may obtain diagnosis information by processing the signal or data received from the sensing part 120.

Each of the sensors included in the sensing part 120 may be implemented as physically separated distinct devices or each of the sensors may be implemented as one device. For example, the sensing part 120 is not limited to being implemented as one physical device. The sensing part 120 may transfer a sensing value to the processor 140, the processor 140 may control an operation of the washing apparatus 100 based on the received sensing value, or store the received sensing value in the memory 150 as diagnosis information, or transfer the received sensing value to an external device (e.g., server, smartphone, or the like) through a communication interface 160 and store in an external device.

The sensing part 120 may include a speed sensor 120-1, a weight sensor 120-2, and a temperature sensor 120-3.

The speed sensor 120-1 may sense a rotation speed, a rotation angle, a rotation direction, and the like of the motor 112 or the drum 20. The processor 140 may calculate the rotation speed, the rotation angle, and the rotation direction of the motor 112 or the drum 20 sensed by the speed sensor 120-1 and control an operation of the washing apparatus based thereof.

The speed sensor 120-1 may be implemented as a sensor which uses a method of sensing a load size applied to the motor 112 when the motor 112 rotates the drum 20, a method of sensing an on/off signal of a hall sensor that is adjacent with a position of a rotor while the rotor of the motor 112 is rotating, a method of measuring a magnitude of current that is applied to the driving part 110 or the motor 112 while rotating the drum, or the like.

The weight sensor 120-2 may sense a weight of the drum 20. In addition, the weight sensor 120-2 may sense a weight of laundry and the drum 20 when the laundry is present inside the drum 20, and sense the weight of the laundry contained in the drum 20 using a method of estimating a difference in the sensed weight with a pre-stored weight of the drum 20 as the weight of the laundry.

The weight sensor 120-2 may sense the weight of the drum 20 by rotating the drum 20 with no laundry present therein and obtain as diagnosis information. To this end, the weight sensor 120-2 may sense the weight of the drum 20 using methods that estimate a moment of inertia from the rotation speed and rotation angle of the motor 112 or the drum 20 sensed through the above-described speed sensor 120-1 and estimate a weight that corresponds to the moment of inertia.

The weight sensor 120-2 of another method may be implemented in various sensors that estimate the weight of the drum 20 corresponding to a magnitude of voltage when a form of a load cell is changed as the weight of the drum 20 is applied to the load cell, and the magnitude of voltage in accordance with the changed form is sensed, and the like.

The temperature sensor 120-3 may be an external temperature sensor which senses a temperature of a surrounding environment of the washing apparatus 100, or an internal temperature sensor which senses a temperature inside the washing apparatus 100, such as a temperature of washing water in the tub 15, a temperature of the heater 116, and a temperature of the power supply device 111.

The temperature sensor 120-3 may be implemented as a thermistor which is a type of resistor that uses resistance changing properties of a material according to temperature, and at this time, the thermistor may have negative temperature coefficient (NTC) properties in which resistance is decreased when the temperature is increased and resistance is increased when the temperature is decreased.

The temperature sensor 120-3 may be a temperature sensor that senses the temperatures of the heater 116 and the washing water. The temperature sensor 120-3 may further include a temperature adjusting device (e.g., thermostat), and the temperature adjusting device may sense an amount of heat generated from the heater 116, and control the temperature of the washing water or the drum 20 to be maintained at a specific temperature due to the heat generated from the heater 116.

In addition to the above, the sensing part 120 may further include at least one from among a level sensor that senses a level or a flow rate of washing water, a detergent sensor that senses a type or a residual amount of detergent, a leak sensor that senses leakage of washing water, a humidity sensor that senses humidity in air, a turbidity sensor that detects turbidity of the washing water, a door sensor that senses whether the door 12 is opened or closed, a vibration sensor that senses a degree to which the washing apparatus 100 vibrates, and a valve sensor that senses an operation of the water supply valve 113, the water drain valve 114, or the like.

For example, the sensing part 120 may sense the weight of the drum 20, whether there is abnormality in the water supply valve 113 for supplying washing water to a spin basket 50, a temperature of the washing water being supplied to the spin basket 50, a flow rate of the washing water being supplied to the drum 20, whether there is abnormality in the motor 112, whether there is abnormality in the water drain valve 114 for draining the washing water, a flow rate of the washing water being drained from the drum 20, a vibration of the washing apparatus 100, and the like. Accordingly, the sensing part 120 may assist in improving the washing cycle and washing performance of the washing apparatus 100, and sense whether there is an abnormal operation of the washing apparatus 100.

The display 130 may display diagnosis information obtained through the sensing part 120 in a display area according to the control of the processor 140. The display 130 may be disposed at a front surface of a housing of the washing apparatus 100, and the user may determine an operating status of the washing apparatus 100. Alternatively, the display 130 may be implemented in an outer form and not embedded inside of the washing apparatus 100, and image data may be displayed in the outer display connected with the washing apparatus 100 via wired or wireless means.

The processor 140 may control the overall operation of the washing apparatus 100. To this end, the processor 140 may include a random access memory (RAM), a read only memory (ROM), a graphics processor, a main central processing unit (CPU), a 1st to nth interface, a bus, and the like.

The processor 140 may operate the driving part 110 based on input signal when the user command is received and perform the washing cycle for each stage. While the washing apparatus 100 is being operated, the operating state of the washing apparatus 100 may be sensed through the sensing part 120, and the processor 140 may provide feedback on the operation of the washing apparatus 100 based therefrom, or obtain diagnosis information and display in the display 130.

The memory 150 may be stored with various instructions, programs, or data necessary in the operation of the washing apparatus 100 or the processor 140. The memory 150 may be stored with information obtained by the sensing part 120, and data received from an external electronic device.

The memory 150 may be accessed by the processor 140, and reading/writing/modifying/deleting/updating of data may be performed by the processor 140. Accordingly, in describing the disclosure, the term 'memory' may include the memory 150, a read only memory (ROM) in the processor 130, a random access memory (RAM), or a memory card mounted to the washing apparatus 100.

The memory 150 may be implemented as a volatile memory, such as a static random access memory (S-RAM) or a dynamic random access memory (DRAM), a non-volatile memory, such as a flash memory, a read only memory (ROM), an erasable and programmable read only memory (EPROM), or an electrically erasable and programmable read only memory (EEPROM), a hard disk drive (HDD), a solid state drive (SSD), or the like.

The processor 140 and the memory 150 may be implemented as configurations that are each physically separated, or implemented as a single configuration, such as the processor 140 including the memory 150. In addition, the processor 140 may be implemented as one system with a single configuration or a plurality of configurations therewith. The memory 150 may also be implemented as one system with a single configuration or a plurality of configurations therewith. An operation during the operating of the processor 140 based on the memory 150 described above will be described with reference to the block diagrams in FIG. 4 and thereafter.

The communication interface 160 may transmit and receive data of various types by performing communication with external devices (e.g., server, smartphone, or the like) according to communication standards of various types. For example, the communication interface 160 may transmit information obtained by the sensing part 120 to a server (or a smartphone), or receive a control command for operating the washing apparatus 100 from the server (or the smartphone).

The communication interface 160 may include at least one from among a Bluetooth chip, a Wi-Fi chip, a wireless communication chip, and a NFC chip that performs wireless communication or an Ethernet module and a USB module that performs wired communication. In this case, the Ethernet module, the USB module, and the like that performs wired communication may perform communication with an external device through an input and output port.

The input interface 170 may be a configuration that can receive a user command of various methods from the user, and transfer the received user command to the processor 140. To this end, the input interface 170 may include the input device 13, such as a touch panel or a key, a plurality of operation buttons, and a rotation lever.

A speaker 180 may be embedded in the washing apparatus 100 and may output not only various audio data to which various processing operations have been performed, such as decoding, amplification, or noise filtering by an audio processor (not shown), but also output directly to sound various notification sounds or voice messages.

A washing course of the washing apparatus 100 will be briefly described below with respect to a structure of the above-described washing apparatus 100 and an operation of the processor.

When the user command for managing the washing apparatus 100 is received, the processor 140 may supply, as the water supplying cycle, the washing water to the drum 20. Specifically, the processor 140 may control the water supply valve 113 to be opened by changing the water supply valve 113 in the off-state to the on-state, and accordingly, the washing water may be supplied to the drum 20.

In this case, the processor 140 may adjust a time of maintaining the on-state of the water supply valve 113, and adjust an amount of washing water that is supplied to the drum 20. At this time, the amount of washing water that is supplied from the washing course may be determined based on the capacity of the drum 20. For example, the amount of washing water that is supplied from the washing course may be determined by a maximum amount or an amount of a pre-set ratio that could be contained in the drum 20. In addition, the processor 140 may adjust a temperature of the washing water that is supplied to the drum 20 by adjusting the time maintaining the on-state of the water supply valve 113 with respect to cold water and hot water. The processor 140 may also operate the heater 116 and adjust the temperature of the washing water.

The processor 140 may control for the water supply valve 113 to be closed by changing the water supply valve 113 in the on-state to the off-state when the washing water of a pre-set amount is supplied to the drum 20, and accordingly stop the supply of washing water.

When the water supplying cycle is completed as the supply of washing water is stopped, the processor 140 may control, as the washing cycle, the driving part 110 for the washing water filled in the drum 20 to be rotated.

The processor 140 may apply a control signal for rotating the drum that is filled with washing water to the power supply device 111 in the motor 112 of the driving part 110, and the power supply device 111 may rotate the drum 20 by rotating the motor 112 according to the applied control signal and transferring the rotational force to the drum 20. In addition, the processor 140 may control the waterjet 117 to spray high-temperature and high-pressured washing water to remove contaminants attached to the inside of the drum 20 and the laundry.

When the washing cycle is complete, the processor 140 may drain, as the water draining cycle, the washing water that is filled in the drum 20. Specifically, the processor 140 may control the water drain valve 114 to be opened by changing the water drain valve 114 in the off-state to the on-state, and accordingly, drain the washing water that is filled in the drum 20 to the outside. In addition, the processor 140 may control the pump 115 to discharge the washing water filled inside the drum 20 to the external water drain pipe 400 by using motive power or pressure.

The processor 140 may control, as the spin-drying cycle, the driving part 110 to rotate the drum 20. The power supply device 111 may rotate the drum 20 by operating the motor 112 according to the applied control signal and transferring the rotational force to the drum 20. The control signal may be a signal for operating the motor 112 in stages, and may be a signal for operating the motor at a rotation speed that is decreased, increased or maintained according to time.

In the above-described embodiment of the disclosure, the water draining cycle and the spin-drying cycle have been described as being performed separately, but this is merely one embodiment of the disclosure, and the water draining cycle and the spin-drying cycle may be concurrently performed, or it may also be possible to perform the water draining cycle after the spin-drying cycle.

Figure 4:
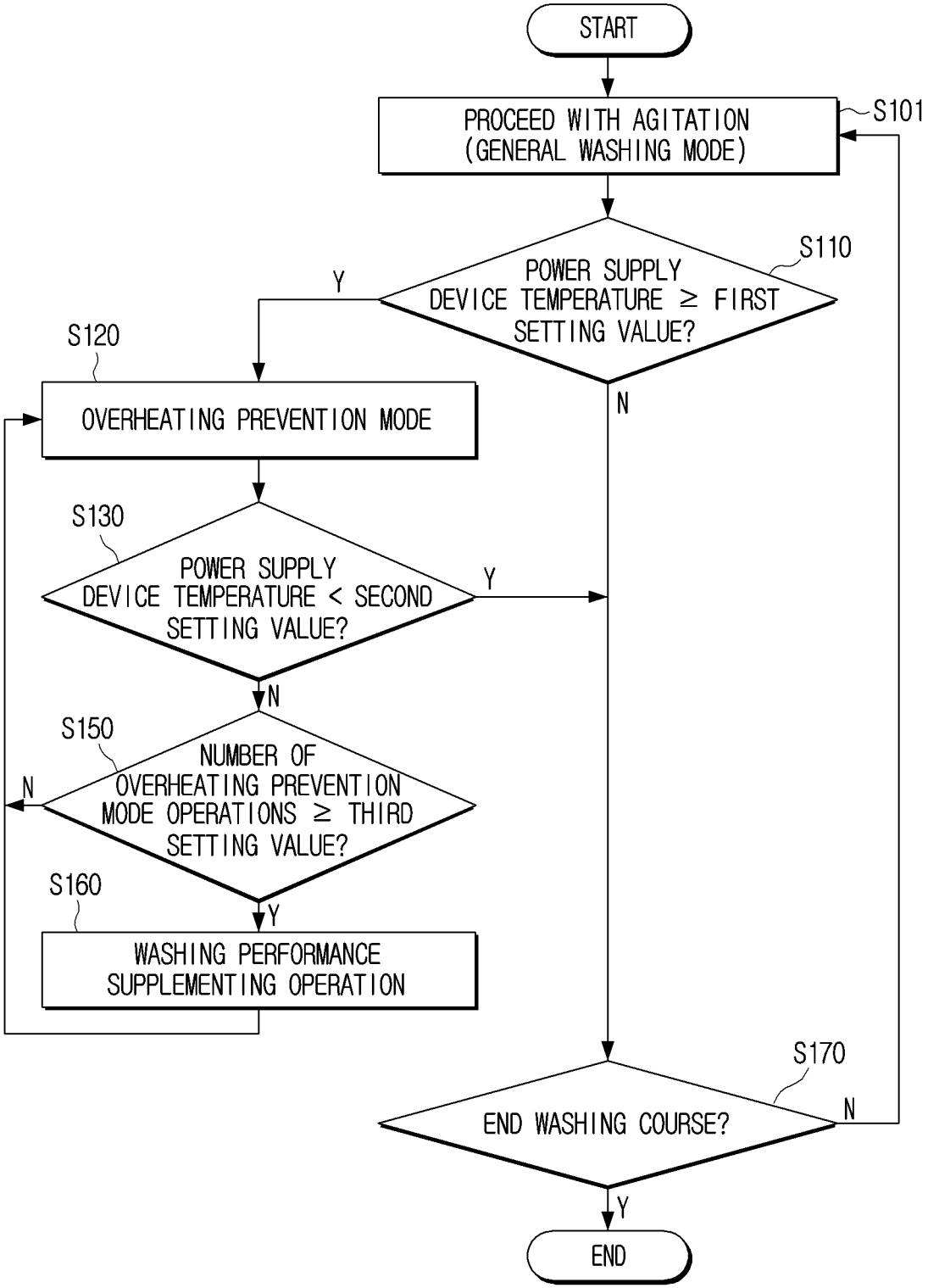
FIG. 4 is a flowchart illustrating a controlling method of a washing apparatus according to an embodiment of the disclosure.

FIG. 4 is a flowchart illustrating a controlling method of the washing apparatus according to an embodiment of the disclosure.

A controlling method of the washing apparatus 100 (S100) may be implemented, by the processor 140, by proceeding with each step, and may be realized as a program that includes an executable algorithm that can be executed from a computer.

The program which includes the algorithm may be provided stored in the memory 150 which is a non-transitory computer readable medium. The non-transitory computer readable medium may refer to a medium that stores data semi-permanently rather than storing data for a very short time, such as a register, a cache, a memory, or the like, and is readable by a device. Specifically, the programs for performing the above-described various methods may be provided stored in the non-transitory computer readable medium, such as, for example, and without limitation, a compact disc (CD), a digital versatile disc (DVD), a hard disc, a Blu-ray disc, a universal serial bus (USB), a memory card, a ROM, and the like.

A process after the processor 140 receives the input signal will be described below with reference to the block diagram of FIG. 4.

The processor 140 may operate, based on receiving an input signal on an operation of the washing apparatus 100 of performing operations, such as the washing cycle, the rinsing cycle, or the spin-drying cycle, the motor 112 by controlling the power supply device 111 based on the received input signal at operation S110. One cycle step, such as the washing cycle, the rinsing cycle, or the spin-drying cycle will be referred to as a 'washing course' below.

The input washing course may proceed as the drum 20 is rotated by the motor 112 and the laundry, the washing water, the detergent, or the like contained inside the drum 20 is agitated. The input signal may be a signal for sequentially proceeding with at least one from among the one washing course, such as the washing cycle, the rinsing cycle, and the spin-drying cycle, and the operating state based on this input signal may be referred to as a 'general washing mode.' The 'general washing mode' may be differentiated from an 'overheating prevention mode' which will be described below.

The temperature sensor 120-3 may sense a temperature of the power supply device 111 and transfer to the processor 140, and the processor 40 may determine the temperature of the power supply device 111 with the received sensing value at operation S110. More specifically, the processor 140 may determine whether the temperature of the power supply device 111 is greater than or equal to a first temperature which is a pre-set first setting value. In this case, the temperature sensor 120-3 may be the temperature sensor 120-3 that senses the temperature of the power supply device 111.

When the motor 12 performs a washing course that requires high power, for example, when a weight of the laundry sensed from the weight sensor 120-2 is greater than a pre-set value, the power supply device 111 may be overheated as the motor 112 is rotated and heat generated therefrom is increased. When the power supply device 111 is overheated to a certain temperature or more, a component of the power supply device 111 may be damaged or a malfunction may occur, and a problem in safety may occur. Accordingly, the temperature sensor 120-3 may provide the temperature of the power supply device 111 to the processor 140, and the processor 140 may control an operation of the motor 112 such that the power supply device 111 is not overheated.

When the temperature of the power supply device 111 is greater than or equal to the first temperature which is the pre-set first setting value, the operation of the motor 112 may be controlled in an overheating prevention mode at operation S120. The overheating prevention mode may be an operating method that is distinguished from the general washing mode, and may be an operating method that reduces power consumption of the motor 112.

The general washing mode and the overheating prevention mode may have operation times of the motor 112, rotation RPM of the motor 112, operation intervals of the motor 112, and the like that are different from each other. Among the above, as an example of an operation time and a stopping of the operation time of the motor 112 being different, the general washing mode may be a method (A1-B1) of the motor 112 being operated for A1 minutes and then stopping operation for B1 minutes, and during the general washing mode, it may be a method of repeating the operating and the stopping the motor 112 a plurality of times in this pattern.

In this case, the overheating prevention mode according to an embodiment may be a method (A2-B1) of operating for A2 minutes which is less than A1 in the general washing mode and then stopping the operation for B1 minutes, and the overheating of the power supply device may be prevented by decreasing the operation time of the motor 112 and reducing heat generated by the operation of the motor. Alternatively, the overheating prevention mode according to another embodiment may be a method (A1-B2) of operating for A1 minutes and then stopping the operation for B2 minutes which is greater than B1, and the overheating of the power supply device may be prevented by increasing the time by which heat generated during the operation of the motor is cooled. The overheating prevention mode according to still another embodiment may be a method (A2-B2) of operating for A2 minutes which is less than A1 and then stopping the operation for B2 minutes which is greater than B1, and the overheating of the power supply device may be prevented by reducing the heat generated by the operation of the motor, and increasing the time by which heat generated during the operation of the motor is cooled.

Alternatively, the overheating prevention mode according to an embodiment may control the rotation RPM of the motor 112 to operated lower than a general operating mode. In addition thereto, the above-described overheating prevention mode may be one from among the embodiments of the disclosure and is not limited thereto, and the overheating prevention mode may be satisfied as long as it is an operating method that prevents the overheating of the power supply device 111 and reduces the power consumption of the motor 112.

The operating method of the overheating prevention mode may be controlled by the processor 140, or the power supply device 111 may be configured as the Intelligent Power Module (IPM), and operate the motor 112 in the overheating prevention mode based on the sensed temperature.

According to an embodiment of the disclosure, the processor 140 may increase, based on the power supply device 111 being operated in the overheating prevention mode, the driving force of the cooling fan 119 to cool the power supply device 111. For example, if the cooling fan 119 was in a state that is not operated in the general washing mode, the cooling fan 119 may be operated in the overheating prevention mode, and if the cooling fan 119 was being operated in the general washing mode, a cooling performance may be enhanced by further increasing the driving force of the cooling fan 119 in the overheating prevention mode.

The processor 140 may lower the temperature of the power supply device 111 by the operation of the overheating prevention mode. The temperature sensor 120-3 may sense the temperature of the power supply device 111 at a certain period or in real-time and provide to the processor 140, and the processor 140 may determine that the temperature of the power supply device 111 is a pre-set second setting value, and whether it is less than a second temperature which is lower than the first temperature at operation S130.

If the temperature of the power supply device 111 is greater than or equal to the second temperature which is the pre-set second setting value, the processor may continue to operate the motor 112 in the overheating prevention mode for the temperature of the power supply device 111 to be less than the second temperature. In this case, the first setting value and the second setting value may vary according to an operating environment of the washing apparatus 100, and specific specifications of the motor 112 and the power supply device 111, and for example, the first setting value may be set within a range of between 70 degree Celsius and 80 degree Celsius, and the second setting value may be set within a range of between 60 degree Celsius and 70 degree Celsius.

If the temperature of the power supply device 111 is less than the second temperature which is the pre-set second setting value, the motor 112 may end the overheating prevention mode, and determine whether the washing course is ended at operation S170. Then, if the washing course has not ended, the it may return back to the general washing mode and the operation may be controlled at operation S101. In addition, if the temperature of the power supply device 111 is less than the first setting value in the above-described temperature determining step at operation S110, the motor 112 may not enter into the overheating prevention mode, and proceed with the washing course by determining whether to end the washing course at operation S170 and continuing to maintain the general washing mode.

The controlling method of the washing apparatus 100 (S100) may, by including the operation of the above-described overheating prevention mode, effectively lower the temperature of the power supply device 111 and proceed with the washing course even when the power supply device 111 is being overheated due to a high load to the motor 112 being required for reasons such as the weight of the laundry, and the like, and prevent a performance deterioration, a component damage, a malfunction, a problem in safety, and the like by the overheating of the power supply device 111.

However, regardless of whether or not the overheating prevention mode is entered, a total time required in the washing course that includes the overheating prevention mode may be maintained same as when compared with the washing course that proceeded in only the general washing mode. A reason for the above is to prevent user inconvenience due to an additional time spent by preventing the washing time from becoming longer than an estimated time of the washing apparatus 100 guiding the user by displaying an estimated washing time at a starting point of the operation, and preventing the washing time from being spent longer than the washing time estimated by the user in general.

If the temperature of the power supply device 111 is not less than the second temperature, the processor 140 may repeat the operation method in the overheating prevention mode a plurality of times. In this case, a number of overheating prevention mode operations may be calculated assuming that an operation time and an operation stop time of the motor 112 is considered as one-time cycle in the overheating prevention mode. Alternatively, a number of rotations of the motor 112 during the overheating prevention mode may be based upon, and the number of times may be calculated by setting an operation time of reducing the rotation RPM of the motor 112 as one-time cycle. For example, the number of overheating prevention mode operations may be counted, by the processor 140, by a certain period or considering the transfer of a specific signal as one time, and if the number of times is greater than or equal to a third setting value, additional operations for preventing the deterioration in the washing performance may be controlled.

The processor 140 may determine whether an operation value of the motor 112 is greater than or equal to the third setting value which is the pre-set value at operation S150. The operation value of the motor 112 may be a number of overheating prevention mode operations during the overheating prevention mode, a rotation RPM of the motor 112, the operation time of the motor 112, and the like, the speed sensor 120-1 may sense the number of overheating prevention mode operations, the rotation RPM, the rotation RPM of the drum 20, or the like and transfer to the processor 140, and the processor 140 may calculate or estimate the operation value of the motor 112 through the received sensing value.

While repeating the overheating prevention mode by a plurality of times, the processor 140 may count the number of overheating prevention mode operations S150. Then, continue to repeat the overheating prevention mode if the number of overheating prevention mode operations is less than the pre-set value, and the processor 140 may perform a washing performance supplementing operation if the number of overheating prevention mode operations becomes greater than the pre-set value at operation S160.

The pre-set value may be the third setting value, and the third setting value may vary according to the operation method in the overheating prevention mode, the operating environment of the washing apparatus 100, and the specific specifications of the motor 112 and the power supply device 111. For example, if the 'number of operations' in the overheating prevention mode is based on a signal input to enter the overheating prevention mode or a number of entries, the third setting value may be set within a range of between three times and fifteen times, or the third setting value may be set within a range of between twenty times to one hundred times, and preferable fifty times, if the number of operations is based on a number of motor rotations in the overheating prevention mode, and the third setting value may be set within a range of between 5 minutes and 40 minutes, and preferably 10 minutes, if the number of operations is based on the operation time of the motor 112 during the overheating prevention mode.

Because the overheating prevention mode may be an operation in which the total operation time, the rotation RPM, or the like of the motor 112 is smaller than or lower than that in the general washing mode as described in the above, the washing performance may be deteriorated compared to when washing for a same time in the general washing mode. Accordingly, based on the number of overheating prevention mode operations, when having been operated by the threshold setting value or more, the processor 140 may perform an operation of supplementing the washing performance to supplement the washing performance. The operation described above may be referred to as a 'washing performance supplementing operation' below. The washing performance supplementing operation will be described with reference to FIG. 5.

The washing performance supplementing operation may be an operation that improves the washing performance by supplementing a function that is deteriorated from the overheating prevention mode, and if the above is numerically described for convenience of description, if the washing performance in the overheating prevention mode is between 5% and 10%, the washing performance of between 5% and 10% may be supplemented for the washing performance supplementing operation.

If the temperature of the power supply device 111 is sensed as less than the second setting value due to the overheating prevention mode, the processor 140 may determine if the washing course is ended according to the input signal at operation S170. If the washing course has not yet ended or if there is a pre-set certain time or more remaining until the end of the washing course, the processor 140 may return back to the controlling the operation of the motor 112 at operation S101 in the general washing mode. Then, proceed with the washing course by going through the above-described process again.

If the washing course is ended by the input signal, the washing apparatus 100 may end the operation or proceed with a next cycle.

Figure 5:
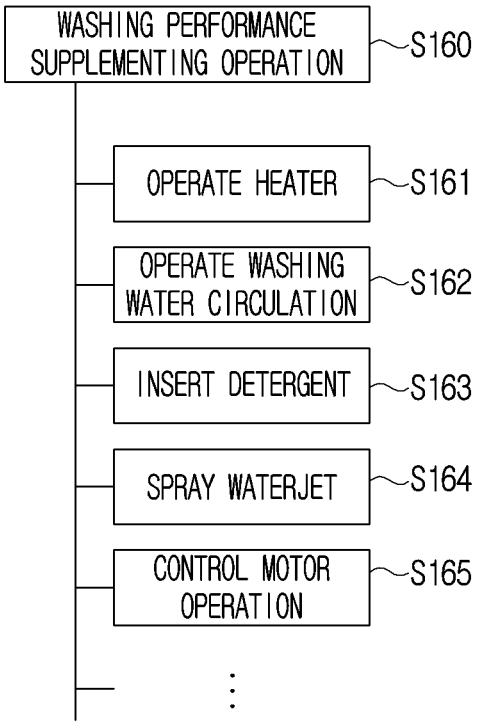
FIG. 5 is a block diagram illustrating a washing performance supplementing operation according to an embodiment of the disclosure.

FIG. 5 is a block diagram illustrating a washing performance supplementing operation according to an embodiment of the disclosure.

Referring to FIG. 5, a washing performance supplementing operation S160 may include operating the heater at operation S161, operating pump circulation at operation S162, inserting detergent at operation S163, and the like.

The washing performance supplementing operation S160 may be an additional operation of the washing apparatus 100 to prevent the deterioration of the washing performance during the overheating prevention mode as briefly described in FIG. 4, and may be an operation for supplementing the washing performance without increasing the total time required of the washing course.

The washing performance supplementing operation S160 may be a heater operation S161. The heater 116 may be installed inside the tub 15 or mounted to the tub 15 or the drum 20 heating the washing water and raising the temperature of the washing water and the laundry, and improve the washing performance. Alternatively, with respect to the spin-drying and drying cycle, drying of the laundry may be assisted by heating the drum 20. For convenience of description, description based on the washing course with the washing water included inside the drum will be described below, but the same may be applied for the spin-drying and drying cycle.

The heater operation S161 may be a method of controlling an operation of the heater to increase power consumption of the heater 116, and the operation time of the heater 116 during the heater operation S161 may be a first operation time which is a pre-set time, or a time until the temperature of the washing water is raised by a first temperature difference which is a pre-set temperature value. The first operation time and the first temperature difference which are the standard of the heater operation S161 may vary according to the operating environment of the washing apparatus 100, and specific specifications of the motor 112 and the power supply device 111, and vary based on the third setting value which is a condition for entering into the washing performance supplementing operation. In addition, the pre-set time by which the heater 116 operates may vary according to power supply and specification of the heater 116.

The heater operating S161 operation, that is, in an example of heating the washing water to supplement the washing performance, if rated voltage is 110 V and the power consumption of the heater 116 is 900 W, the heater 116 may be operated for about 10 minutes to increase the temperature of the washing water by 2 degree Celsius, and if the rated voltage is 220 V and the power consumption of the heater 116 is 2000 W, the heater may be operated for about 2 minutes to increase the temperature of the washing water by 2 degree Celsius. Accordingly, the first temperature difference as the temperature for supplementing the washing performance may be between 1 degree Celsius and 4 degree Celsius, and may be preferably set at 2 degree Celsius, and based therefrom, the first operation time may be formed between 2 minutes and 10 minutes.

Based on a rise in water temperature of the washing water by the heater operation S161, the washing performance may be supplemented. Although it may vary according to the type of laundry and the washing environment, the washing performance may be improved, in general, at a threshold point or below as the temperature rises, and if the temperature of the washing water is raised by 2 degree Celsius, a washing effect similar to having proceeded with the washing course by 10 minutes to 20 minutes further may be expected. Accordingly, the washing performance supplementing operation S160 may improve the washing performance by additionally operating the heater 116 corresponding to the number of overheating prevention mode operations.

The washing performance supplementing operation S160 may be a washing water circulating operation S162. Specifically, the processor 140 may control the washing water of the drum 20 to circulate by increasing the driving force of the pump 115 and setting the water supply valve 113 and the water drain valve 114 to the off-state. Alternatively, the processor 140 may control the washing water to circulate by controlling for the used washing water to be drained as new washing water is introduced by increasing the driving force of the pump 115 and setting the water supply valve 113 and the water drain valve 114 to the on-state.

Due the washing water circulating operation S162, the washing performance may be improved as the washing water is sprayed to the laundry by pressure of the pump, or the washing performance may be improved by evenly providing the washing water to a wide area of the laundry as the washing water circulates. In addition, the washing performance may be improved by discharging the contaminated washing water as new washing water is introduced and solubility of the detergent is raised.

An operation time of the pump 115 may vary according to the operating environment of the washing apparatus 100, and specific specifications of the motor 112 and the power supply device 111, and for example, may be formed between 2 minutes and 10 minutes similarly with the first operation time.

The washing performance supplementing operation S160 may be inserting detergent at operation S163. Specifically, if the washing apparatus 100 includes the detergent supply device (not shown) that stores surplus detergent, the processor 140 may improve the washing performance by controlling the detergent supply valve 118 and additionally inserting the detergent in the detergent containing part 14 in the drum 20. In this case, the washing performance supplementing operation S160 may concurrently or sequentially proceed with the detergent insertion at operation S163 and the heater operation S161 and effectively improve the washing performance by raising a dissolution rate of the detergent in the washing water.

A supply amount of detergent in the detergent insertion at operation S163 may be variably set according to the operating environment of the washing apparatus 100 based on the operating environment of the washing apparatus 100, a size of the drum 20, the type of detergent, a capacity of washing water in the washing performance supplementing operation, a volume of the detergent containing part 14, and specific specifications of the motor 112 and the power supply device 111.

The washing performance supplementing operation S160 may be spraying the waterjet at operation S164. If the washing apparatus 100 includes the waterjet 117 configured of the waterjet pump (not shown) and a waterjet nozzle (not shown) that sprays the inside of the drum 20 with high-pressure washing water, the processor 140 may improve the washing performance by raising a spray amount or a spraying pressure of the waterjet 117 in the overheating prevention mode.

For example, if the waterjet 117 is not operated in the general washing mode, the waterjet 117 may be operated in the washing performance supplementing operation, and if the waterjet 117 was being operated in the general washing mode, the driving force of the waterjet 117 may be increased in the washing performance supplementing operation, and a spraying pressure, a spray time, or a spray amount of the waterjet 117 may be increased. Although not shown in the drawings, the waterjet 117 may be implemented through a water draining installation that includes the pump 115.

The spray amount of the waterjet 117 may vary according to the operation environment of the washing apparatus 100, and specific specifications of the motor 112 and the power supply device 111, and the spray time of the waterjet 117 may be formed, for example, between 2 minutes and 10 minutes similar to the first operation time.

The washing performance supplementing operation S160 may be controlling the motor operation S165. The controlling the motor 112 operation S165 according to an embodiment may be an operation that increases the operation time of the motor 112 during the washing course by increasing the washing time more than the estimated time of the washing course according to the input signal. The controlling the motor 112 operation S165 has an advantage that it is implementable in the washing apparatus 100 that does not include the heater 116, the detergent insertion device (not shown), and the like. The operation time of the controlling the motor 112 operation S165 or the rotation RPM of the motor 112 may be set to a value that supplements the washing performance of a same level as with the third setting value based on the third setting value.

In addition, the washing performance supplementing operation S160 is not limited thereto, and may be an operation supplementation that can improve the washing performance, and the operation may be satisfied so long as it is an operation of the washing apparatus 100 for supplementing the motor 112 operation in, specifically, the overheating prevention mode.

Figure 6:
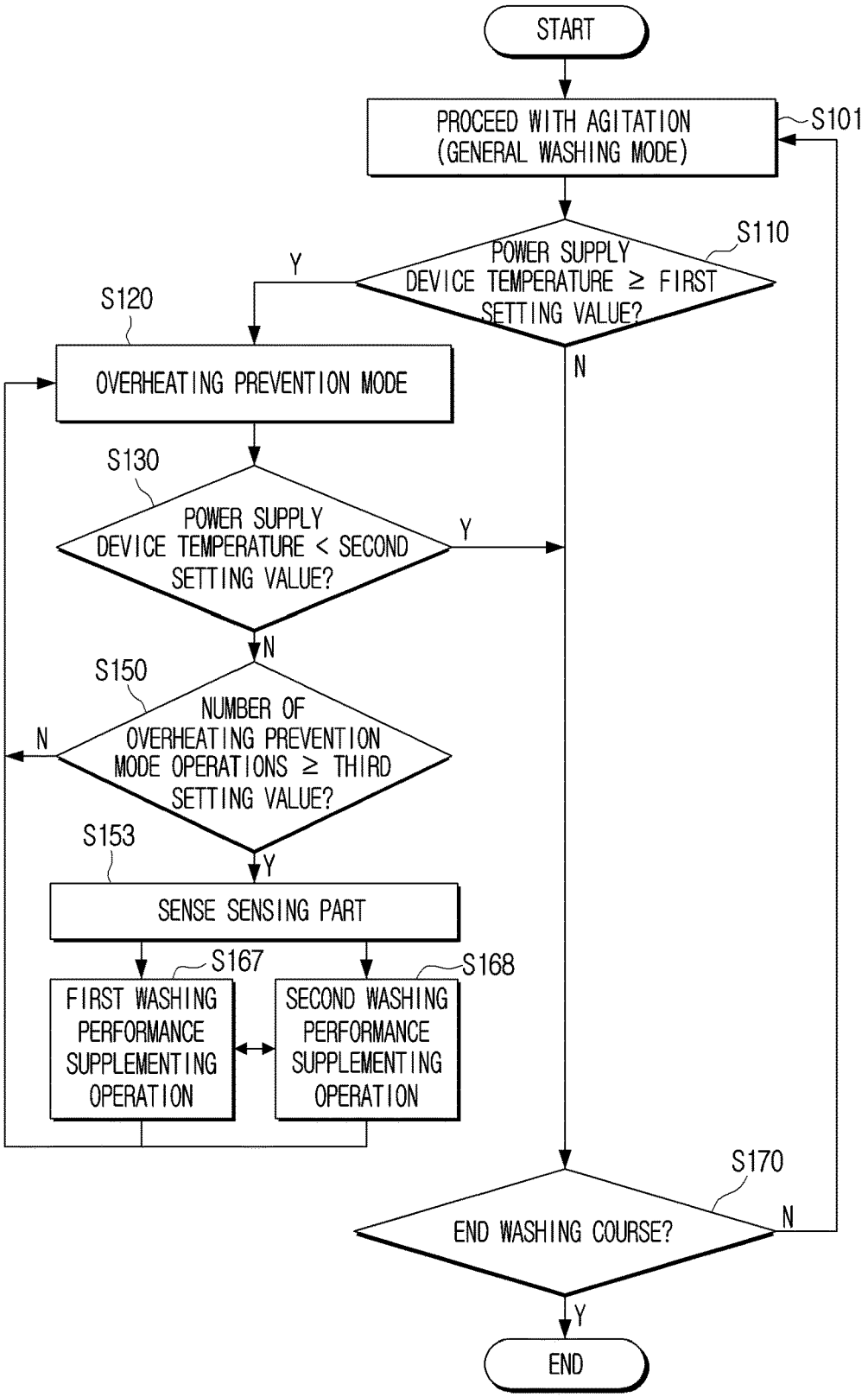
FIG. 6 is a flowchart illustrating a controlling method of a washing apparatus according to an embodiment of the disclosure.

FIG. 6 is a flowchart illustrating a controlling method of the washing apparatus 100 according to an embodiment of the disclosure.

Referring to FIG. 6, the controlling method of the washing apparatus 100 (S100) may further include sensing the sensing part at operation S153, a first washing performance supplementing operation S167, and a second washing performance supplementing operation S168. For reference, the descriptions of operations corresponding to the flowchart of FIG. 5 from the flowchart of FIG. 6 will be omitted, and operations that are different will be mainly described.

The processor 140 may determine whether the operation value of the motor 112 is greater than or equal to the third setting value which is the pre-set value at operation S150, and if the number of overheating prevention mode operations during the overheating prevention mode is greater than a pre-set third setting value, perform the washing performance supplementing operation S153 by grasping a current operating state of the washing apparatus 100 through the sensing part 120.

The processor 140 may set a time or intensity of the washing performance supplementing operation based on the sensing value of the sensing part 120 and control the same through the sensing the sensing part at operation S153, or select an appropriate washing performance supplementing operation method.

One from among the first washing performance supplementing operation S167 and the second washing performance supplementing operation S168 which is one from among the above-described washing performance supplementing operation may be selectively operated according to the sensed result of the sensing part 120, or the first washing performance supplementing operation S167 and the second washing performance supplementing operation S168 may be operated concurrently, or the first washing performance supplementing operation S167 and the second washing performance supplementing operation S168 may be sequentially operated. An embodiment of the controlling method of the washing apparatus 100 (S100) according to the flowchart of FIG. 6 will be described below.

The controlling method of the washing apparatus 100 according to an embodiment of the disclosure may include the processor 140 selectively performing, based on the temperature sensor 120-3 that senses the temperature of the washing water, only one from among the heater operation S161 and a circulation operation of the pump 115 S162 as the first to second washing performance supplementing operations S167 and S168 or perform the two types concurrently or sequentially.

Specifically, if the temperature of the washing water sensed by the temperature sensor 120-3 is greater than or equal to a pre-set third temperature, the processor 140 may control the heater 116 for the temperature of the washing water to reduce, and increase the driving force of the pump 115 that supplies the washing water to the drum 20.

When the temperature of the washing water is measured as greater than or equal to a pre-set temperature, the laundry may be damaged by the high temperature according to the type of laundry, and an operating power consumption of the heater 116 for raising the temperature of the washing water may become greater. Accordingly, the processor 140 may set, through the heater 116, a maximum value of temperature increase in the washing water as a third temperature taking into consideration the washing environment, and select the washing performance supplementing operation based therefrom. If the temperature of the washing water is sensed as greater than or equal to the pre-set third temperature, the operation of the heater 116 may be ended or the power provided to the heater 116 may be lowered, and the washing performance supplementing operation may be performed in a method of increasing the driving force of the pump 115 that supplies the washing water to the drum 20.

The controlling method of the washing apparatus 100 according to still another embodiment of the disclosure may include the processor 140 selectively performing one from among the first to second washing performance supplementing operations S167 and S168 based on the weight sensor 120-2 that senses the weight of the laundry, or performing the two types concurrently or sequentially.

Specifically, if the weight of the laundry is greater than or equal to the pre-set value, the operation value during the overheating prevention mode may have a value that is relatively higher than the third setting value, and it may be insufficient to supplement the washing performance with just the washing performance supplementing operation of one operation. Accordingly, at least two washing performance supplementing operations may be performed concurrently or sequentially, and further, although not shown in the drawing, the processor 140 may supplement the washing performance appropriately thereto taking into consideration the separate washing situations by performing a third washing performance supplementing operation (not shown).

Accordingly, the controlling method of the washing apparatus 100 (S100) may sense separate washing environments through the sensing the sensing part at operation S150 prior to performing the washing performance supplementing operation S160 and flexibly perform the washing performance supplementing operation based therefrom.

Figure 7:
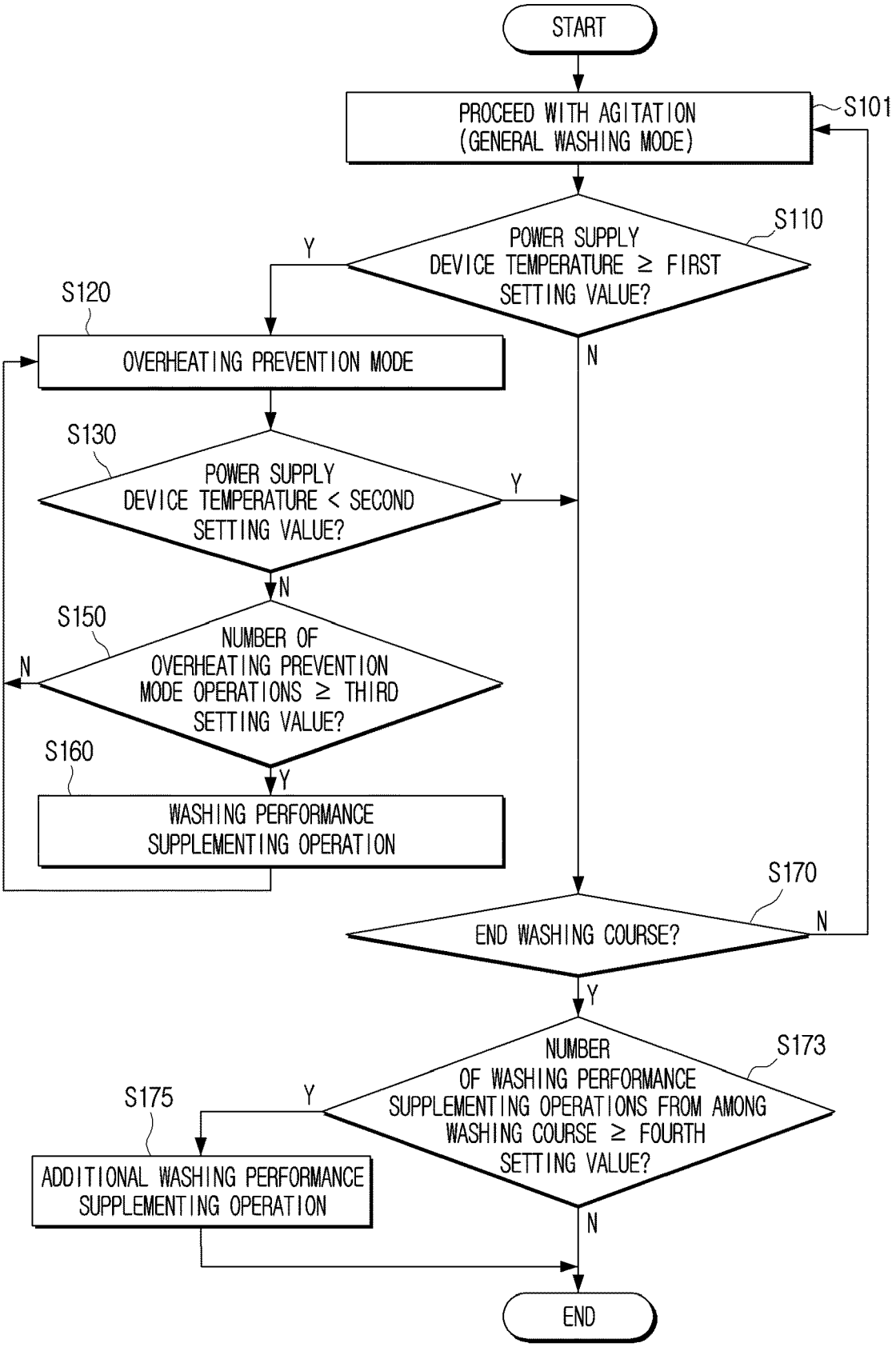
FIG. 7 is a flowchart illustrating a controlling method of a washing apparatus according to an embodiment of the disclosure.

FIG. 7 is a flowchart illustrating a controlling method of the washing apparatus 100 according to an embodiment of the disclosure.

Referring to FIG. 7, the controlling method of the washing apparatus 100 (S100) may further include determining the number of overheating prevention modes from among the washing course at operation S173 and an additional washing performance supplementing operation S175. Descriptions on operations corresponding to the flowchart of FIG. 5 from the flowchart of FIG. 7 will be omitted, and operations that are different will be mainly described.

After determining whether the washing course is ended at operation S170 by the input signal, if the washing course is ended or if there is less than the pre-set certain time remaining until the end of the washing course, the processor 140 may determine the number of operations of the washing performance supplementing operation from among the washing course at operation S173.

The processor 140 may end the operation or proceed with the next cycle if the number of washing performance supplementing operations from among the washing course is less than a fourth setting value which is a pre-set number.

However, the processor 140 may end the operation or proceed with the next cycle after going through the additional washing performance supplementing operation S175 if the number of washing performance supplementing operations from among the washing course is greater than or equal to the fourth setting value which is the pre-set number.

If the number of washing performance supplementing operations is greater than or equal to the fourth setting value, the washing performance supplementing operation of a plurality of times may be repeated and proceeded, and because there is a limit to the effect of supplementing the washing performance, the processor 140 may perform the washing performance supplementing operation additionally after the washing course is ended when the washing performance supplementing operation is operated by greater than or equal to the fourth setting value.

The additional washing performance supplementing operation S175 may correspond to the washing performance supplementing operation S160 in FIG. 5, and specifically, the washing performance may be supplemented by controlling the motor 112 to additionally operate S165 after the washing course is ended.

The fourth setting value may vary according to the operating environment of the washing apparatus 100, and specific specifications of the motor 112 and the power supply device 111, and may be set within a range of between 3 times and 10 times.

Consequentially, the washing apparatus 100 may prevent the washing performance from falling less than or equal to an expectation level when being proceeded a plurality of times in the method of the overheating prevention mode from among the washing course, and prevent a phenomenon of the washing performance being deteriorated by the overheating of the power supply device 111 by controlling for the washing time to inevitably increase only in specific situations according to a number of entering the overheating prevention mode.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A method of controlling a washing apparatus that comprises a power supply device, the method comprising:

controlling an operation of a motor in a general washing mode;

determining a temperature of the power supply device;

controlling, based on the temperature of the power supply device being greater than or equal to a pre-set first temperature, an operation of the motor in an overheating prevention mode that reduces power consumption of the motor;

repeating an operation in the overheating prevention mode a plurality of times such that the temperature of the power supply device becomes less than a second temperature which is lower than the first temperature; and controlling, based on a number of overheating prevention mode operations becoming greater than a pre-set value, an operation of a heater for power consumption of the heater that heats washing water to increase.

2. The method of claim 1, wherein the controlling of the operation of the heater comprises additionally operating the heater for a pre-set time.

3. The method of claim 1, wherein the controlling of the operation of the heater comprises additionally operating the heater for the temperature of the washing water to rise by a pre-set temperature difference.

4. The method of claim 1, further comprising:

increasing, based on a number of overheating prevention mode operations becoming greater than the pre-set value, a driving force of a pump that is configured to supply the washing water to a drum after repeating an operation in the overheating prevention mode a plurality of times.

5. The method of claim 1, wherein the repeating of the operation in the overheating prevention mode a plurality of times comprises:

sensing a temperature of the washing water; and controlling, based on the temperature of the washing water being greater than or equal to a pre-set third temperature, the heater to reduce the temperature of the washing water, and increasing a driving force of a pump that is configured to supply the washing water to a drum.

6. The method of claim 1, further comprising:

controlling, based on the number of overheating prevention mode operations becoming greater than the pre-set value, a detergent supply valve for a detergent supply amount of a detergent containing part that is configured to supply detergent to a drum to increase after repeating an operation in the overheating prevention mode a plurality of times.

7. The method of claim 1, further comprising:

controlling, based on the number of overheating prevention mode operations becoming greater than the pre-set value, a waterjet for a spray amount of the washing water of the waterjet configured to spray high-pressured washing water to a drum to increase after repeating an operation in the overheating prevention mode a plurality of times.

8. The method of claim 1, further comprising:

controlling, based on the temperature of the power supply device becoming less than a pre-set second temperature, an operation of the motor in the general washing mode.

9. The method of claim 1, further comprising:

determining whether a washing course is ended by an input signal, and determining whether the washing course is ended comprises:

returning back to determining the temperature of the power supply device based on the washing course not yet being ended.

10. A washing apparatus comprising:

a main body comprised with a tub;

a rotatable drum comprised in the tub and configured to contain laundry;

a motor configured to provide motive power that rotates the drum;

a heater configured to heat washing water in the tub;

a power supply device configured to control a rotation of the motor; and a processor configured to:

control, based on a temperature of the power supply device being greater than or equal to a pre-set first temperature, an operation of the motor by repeating the operation in an overheating prevention mode that reduces power consumption of the motor a plurality of times such that the temperature of the power supply device becomes less than a second temperature which is lower than the first temperature, and control, based on a number of overheating prevention mode operations being greater than a pre-set value, for the heater to operate so as to increase power consumption of the heater.

11. The washing apparatus of claim 10, wherein the power supply device is further configured to control an operation of the motor by comprising an Intelligent Power Module.

12. The washing apparatus of claim 10, further comprising:

a cooling fan configured to cool the power supply device, wherein the processor is further configured to increase a driving force of the cooling fan in the overheating prevention mode.

13. The washing apparatus of claim 12, further comprising:

a weight sensor configured to sense a weight of laundry contained in the drum and provide a sensing value to the processor, wherein the processor is further configured to increase the driving force of the cooling fan based on the sensing value of the weight sensor being greater than or equal to a pre-set weight.

14. The washing apparatus of claim 10, further comprising:

a pump configured to flow the washing water in the drum; and a water drain valve configured open and close such that the washing water in the drum is drained or maintained, wherein the processor is further configured to circulate, based on the number of overheating prevention mode operations being greater than the pre-set value, the washing water in the drum by controlling the pump and the water drain valve.

15. The washing apparatus of claim 10, wherein the processor is further configured to increase an operation time of the motor based on the number of overheating prevention mode operations being greater than the pre-set value.

* * * * *